US006047903A

United States Patent [19]

Meyer

[11] Patent Number: 6,047,903

[45] **Date of Patent: *Apr. 11, 2000**

[54] FLUID FLOW CONDITIONER

[75] Inventor: David J. Meyer, Willoughby, Australia

[73] Assignee: Orion Safety Industries Pty. Limited, Liverpool, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/678,192

[22] Filed: Jul. 12, 1996

[30] Foreign Application Priority Data

Jan. 13, 1994 [AU] Australia ..... PM 3333

[51] Int. Cl.[7] ..... B05B 1/14; B05B 1/26

[52] U.S. Cl. ..... 239/524; 239/590.3

[58] Field of Search ..... 239/524, 590.3, 239/553.3, 520

[56] References Cited

U.S. PATENT DOCUMENTS

| | | | |
|---|---|---|---|
| 2,289,494 | 7/1942 | Hadley et al. | 239/590.3 X |
| 3,101,176 | 8/1963 | Goss | 239/524 |
| 3,572,391 | 3/1971 | Hirsch . | |
| 3,779,460 | 12/1973 | Monro | 239/524 X |
| 3,840,051 | 10/1974 | Akashi et al. . | |
| 4,072,170 | 2/1978 | Sagwer et al. | 239/590.3 X |
| 4,497,442 | 2/1985 | Williams . | |
| 4,559,275 | 12/1985 | Matt et al. . | |
| 4,640,461 | 2/1987 | Williams . | |
| 4,730,786 | 3/1988 | Nelson | 239/590.3 |
| 4,828,038 | 5/1989 | Williams . | |
| 4,828,184 | 5/1989 | Gardner et al. . | |
| 5,129,584 | 7/1992 | Ridenoun | 239/590.3 X |

FOREIGN PATENT DOCUMENTS

| | | |
|---|---|---|
| 2143866 | 2/1973 | France . |
| 6-47699 | 2/1994 | Japan . |
| WO 87/07853 | 12/1987 | WIPO . |
| WO 89/09654 | 10/1989 | WIPO . |
| WO 91/01452 | 2/1991 | WIPO . |
| WO 93/11908 | 6/1993 | WIPO . |

*Primary Examiner*—Kevin Weldon
*Attorney, Agent, or Firm*—Jagtiani & Associates

[57] ABSTRACT

The invention is a flow conditioner for a fire nozzle which is located upstream of the nozzle outlet. The conditioner reduces swirl and improves flow characteristics. The conditioner of the present invention is manufactured from a single plate, wherein a plurality of passages for fluid flow are provided. The openings are tapered inwardly on there upstream inlet and tapered outwardly at the discharge opening. A nozzle outlet deflector is connected to the plate by a stem in one embodiment.

23 Claims, 5 Drawing Sheets

FLUID FLOW CONDITIONER

This application Ser. No. 08/678192 is the National stage of Pct/Au95/00013.

FLUID FLOW CONDITIONER

1. Field of the Invention

This invention relates to flow conditioners for fluid nozzles or for fluid measurement.

For the sake of convenience, the invention will be described in relation to flow conditioners for jet type fire fighting water nozzles but it is to be understood that the invention is not limited thereto as it may be applied to other areas of fluid flow such as fluid jets for fountains or fluid measurement.

2. Background Art

Prior art flow conditioners include the vane type and the tube bundle type both of which are located in the fluid stream. A common use of such flow conditioners Is to condition the water stream for jet type fire fighting streams. Although these prior art conditioners are very effective at removing swirl from the water, they are less successful in conditioning other fluid flow properties.

Another kind of prior art flow conditioner is the single plate conditioner which consists of a circular plate having an array of 36 fluid passageways therethrough. Each passageway is tapered inwardly in the direction of the fluid flow and around the-downstream end of each passageway is a tube which is typically 0.13 times the diameter of the plate. The thickness of the plate plus the tubes is also typically 0.13 times the diameter of the plate.

SUMMARY OF THE INVENTION

It is an object of the invention to provide improved plate type flow conditioners which are simpler to manufacture than prior art plate type flow conditioners and which provide better performance than those prior art flow conditioners.

It is a further object of the invention to provide a modified single plate flow conditioner for use in an adjustable spray pattern nozzles such as fog nozzles of the kind used in fire fighting.

According to one aspect of the invention there is provided a fluid flow conditioner comprising a plate having a plurality of fluid passageways therethrough each fluid passageway having an upstream end that is tapered inwardly in the direction of fluid flow and a downstream end that is tapered outwardly in the direction of fluid flow.

According to another aspect of the invention there is provided a fluid flow apparatus comprising a nozzle having a nozzle piece, a pipe or body portion and a coupling flange and a fluid flow conditioner according to the invention.

BRIEF DESCRIPTION OF THE DRAWINGS

In order that the invention may be more readily understood and put into practical effect, reference will now be made to the accompanying drawings in which.

DESCRIPTION OF THE PREFERRED EMBODIMENT

Figure 1:
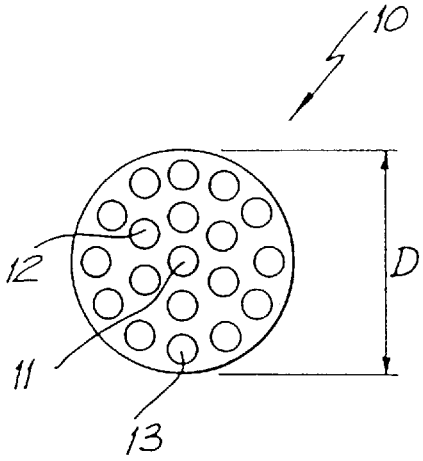
FIG. 1 is a front elevational view of a plate-type flow conditioner according to one embodiment of the invention.
Figure 2:
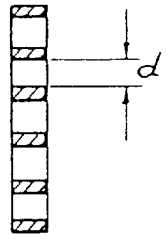
FIG. 2 is a side elevational view of the flow conditioner shown in FIG. 1.

The single plate-type flow conditioner shown in FIGS. 1 and 2 consists of a plate 10 that has a diameter D. There is a central fluid passageway 11, an inner array of six fluid passageways 12 and an outer array of twelve fluid passageways 13. The fluid passageway arrays 12 and 13 are located on circles which are concentric with the centre of the central fluid passageway 11. As shown in FIG. 2, each fluid passageway has a diameter d.

Figure 3:
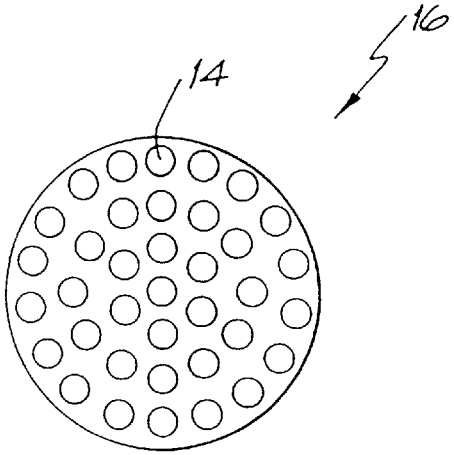
FIG. 3 is a front elevational view of a plate-type flow conditioner according to a second embodiment of the invention, FIG, 4 is a front elevational view of a plate-type flow conditioner according to a third embodiment of the invention.

The flow conditioner 16 shown in FIG. 3 is similar to that shown in FIG. 1 and 2 except that there is a further outer array of 18 fluid passageways 14 located on a circle which is also concentric with the centre of the passageway 11.

Figure 4:
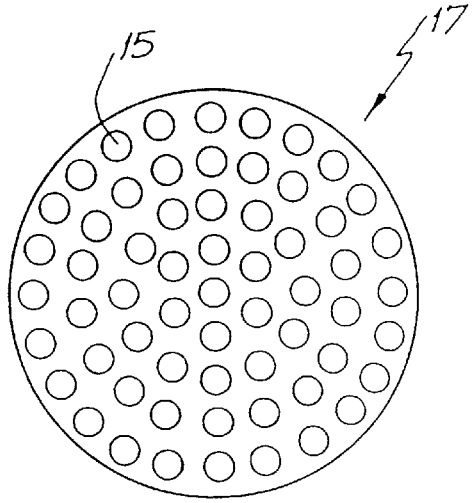

The flow conditioner 17 shown in FIG. 4 is similar to that shown in FIG. 1 and 2 except that there is a further outer array of 24 fluid passageways 15 located on a circle which is also concentric with the centre of the passageway The fluid passageways are spaced evenly over the area of the plate so as to allow for easy manufacture. The number of holes per circle is only approximate and it appears not to be very Important that a number of holes be left out In the outer circles thereby making manufacture slightly easier.

The diameter d of the fluid passageways depend on the number of passageways used in the flow conditioner. For the 19 passageway flow conditioner 10 shown in FIGS. 1 and 2, the passageway size should be in the range of 0.1 to 0.18 times the diameter of the plate D. For the 37 passageway conditioner 16 shown in FIG. 3, the passageway size should be in the range 0.08 to 0.13 times the diameter of the plate D. For the 61 passageway conditioner 17 shown in FIG. 4, the passageway size should be in the range of 0.05 to 0.1 times the diameter of the plate D. It is not essential that all the passageways be of the same size but manufacture is simpler if all the passageways are of the same size.

The thickness of the plate 10 will depend upon the diameter d of the passageways. The thickness of the plate 10 must be a minimum of 0.6 times the diameter d of the passageways with the ultimate being between 1.0 and 1.7 times the diameter d of the passageways. Structural considerations will influence the choice of plate thickness.

The performance of a water jet nozzle depends on the number of fluid passageways. As the number of passageways increases,the quality of the water jet increases. The minimum requirement is 19 passageways to produce a water jet that is visibly superior to the vane or tube bundle type flow conditioners of the prior art.

Increasing the number of holes beyond 19 to 37 and 61 has less effect on the quality of the water jet, however, the spacing between the flow conditioner must be reduced for optimum performance. The shortening of the nozzle/flow conditioner assembly is one of the principle advantages of the invention.

Figure 5:
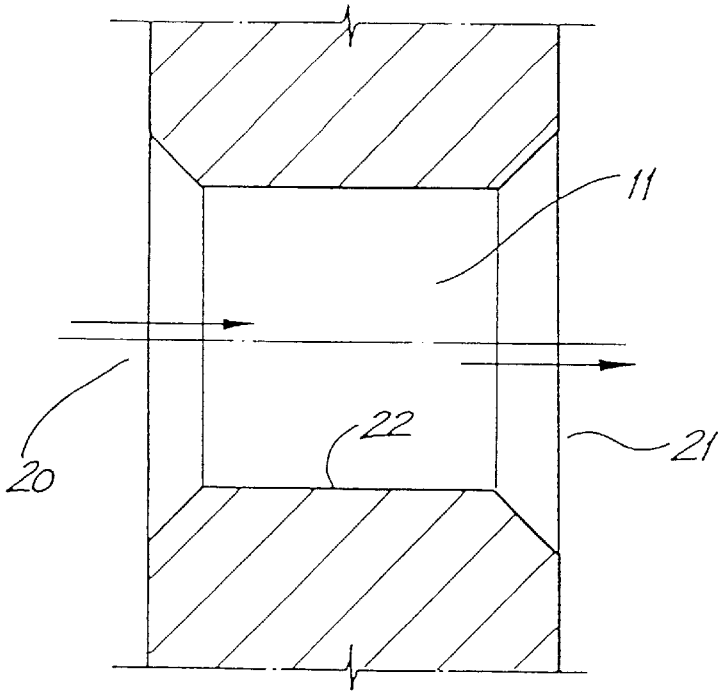
FIG. 5 is an enlarged cross-sectional view of one kind of flow passageway of the plates shown in FIGS. 1 to 4.
Figure 6:
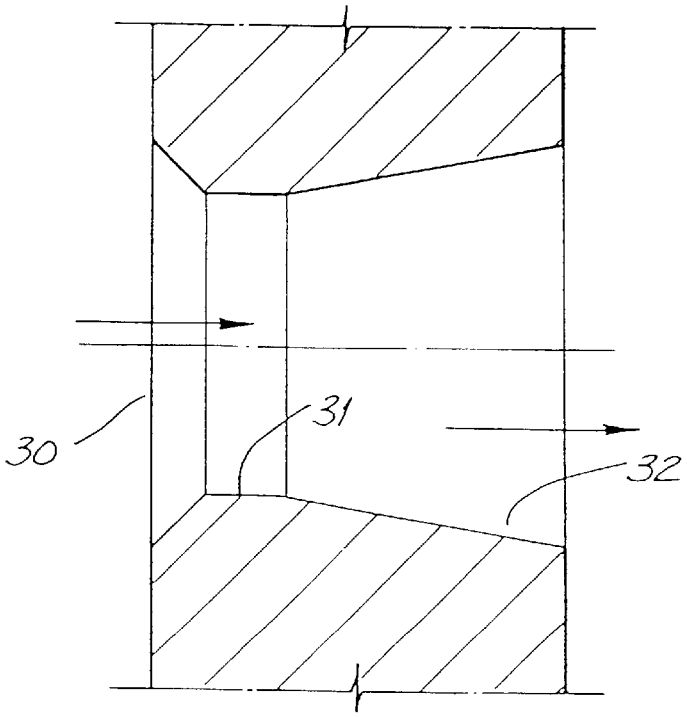
FIG. 6 is an enlarged cross-sectional view of a second kind of flow passageways for the plates shown in FIGS. 1 to 4.

The geometry of alternative fluid passageways is shown in FIGS. 5 and 6. As can be seen in FIG, 5, the upstream end 20 of the fluid passageway 11 is tapered inwardly in the direction of fluid flow and the downstream end 21 of the passageway 11 is tapered outwardly in the direction of fluid flow. The central portion 22 of the passageway 11 is of constant cross-section and is substantially longer than the upstream end 20 or the downstream end 21.

The upstream end 30 of the passageway 11 shown in FIG. 6 tapers inwardly in the direction of fluid flow. Adjacent to the inlet end 30 there is a smaller mid portion of the passageway 31 of constant cross-section and to the right of the mid portion 31 there is an outwardly tapering diffusion portion 32. The diffuser portion 32 is substantially longer than the upstream portion 30 or the mid portion 31. In this instance, the diffuser portion is at least 0.3 times the thickness of the plate 10 and the mid portion 31 is from 0.2 to 0.5 times the diameter d of the passageway. In this instance, each upstream end 20 and downstream end 21 is 0.1 times the diameter d of the passageway.

The geometry of the passageways has significant advantages including improved performance. For large diameter flow conditioners (100 mm and above). all passageways can be cast into the plate and the diffuser side of the passageway of the FIG. 6 embodiment requires no machining. For small diameter flow conditioners, the plate can be moulded or cast in a convenient plastics material. The included angle for the diffuser portion 32 of the FIG. 6 embodiment should be in the range of 0 to 15 degrees with 6 to 10 degrees being preferred. The diffuser could be trumpet shaped instead of conical.

Figure 7:
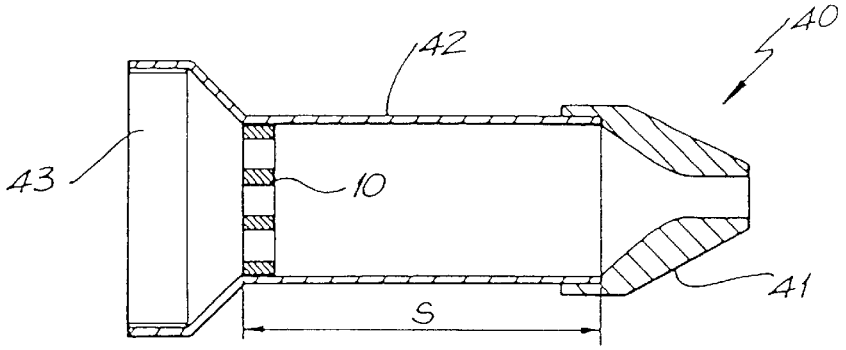
FIG. 7 is a cross-sectional view of a jet-type water nozzle Incorporating a plate-type flow conditioner according to the invention in the body of the nozzle.
Figure 8:
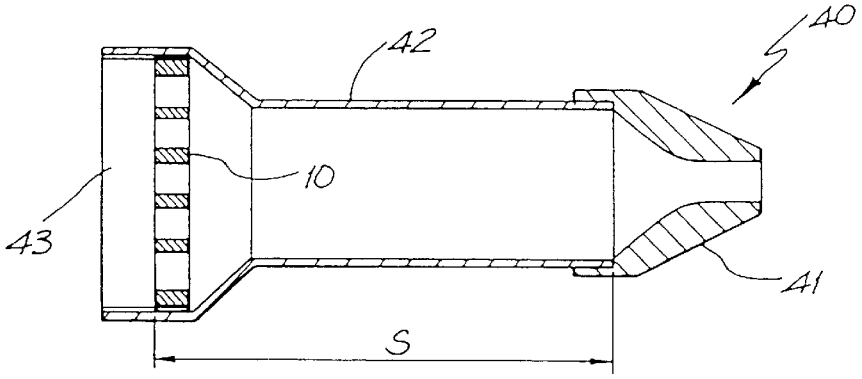
FIG. 8 is a cross-sectional view of a jet type water nozzle incorporating a plate type flow conditioner according to the invention with the conditioner located in the coupling of the nozzle.

FIGS. 7 and 8 show a fire fighting nozzle having a flow conditioner 10 of the invention positioned within a nozzle 40 having a nozzle piece 41, a pipe or body portion 42 and a coupling flange 43. With the 19-hole flow conditioner 10 of FIGS. 1 and 2, the spacing S between the flow conditioner 10 and the nozzle piece 41 must be a minimum of seven pipe diameters. For the 37-passageway conditioner shown in FIG. 3, the spacing S must be between 4 and 7 pipe diameters. The use of shorter or longer spacing with the 37-passageway conditioner of FIG. 3 causes loss of performance.

Figure 9:
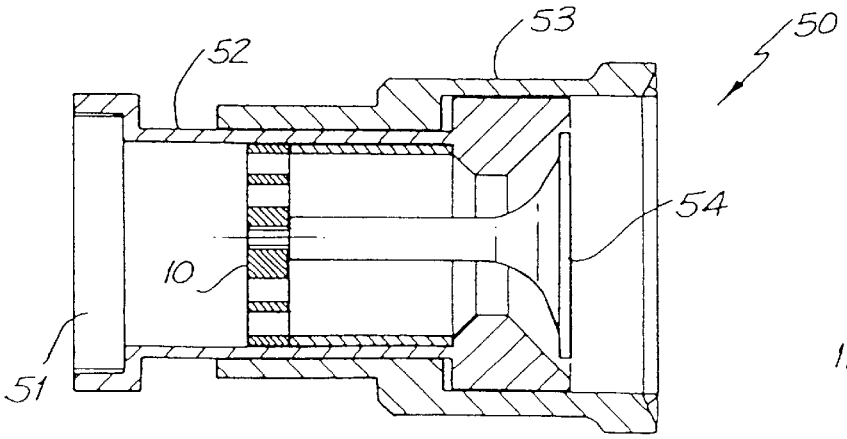
FIG. 9 is a cross-sectional view of a fog type water nozzle incorporating a plate type flow conditioner according to the invention.
Figure 10:
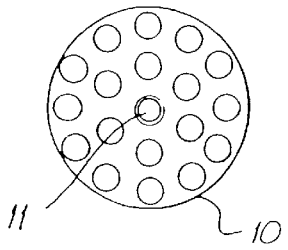
FIG. 10 is a plan view of the plate type flow conditioner of the fog type nozzle shown in FIG. 9.

The flow conditioner 10 may be incorporated into other fire fighting nozzles such as an adjustable spray pattern nozzle or a fog nozzle 50 as shown in FIG. 9. The fog nozzle 50 has a coupling flange 51 a pipe or body portion 52, an adjustable nozzle piece 53 and a stem 54. In this instance, the flow conditioner 10 is used as a retaining plate for the stem 54 which has a threaded end which engages in a correspondingly threaded wall of the central passageway 11.

A flow conditioner of the invention may be incorporated into many variations of the fog nozzle including those fitted with co-axial type proportioners. A flow conditioner used in this manner must have a minimum of six holes with the preferred number being 36. The use of six holes produces little or no improvement in performance unless the water entering the nozzle is very turbulent.

Figure 12:
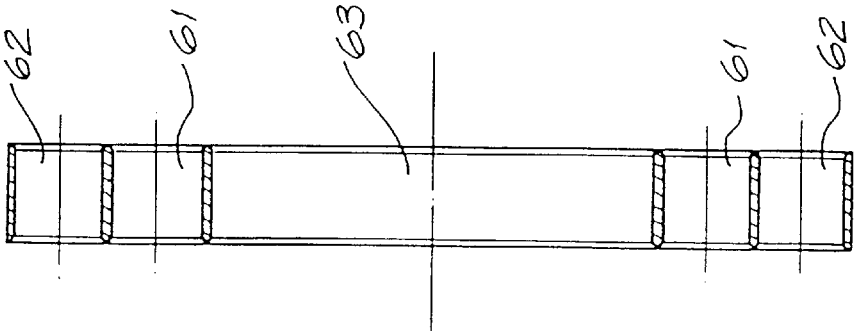
FIG. 12 is a side elevational view of the flow conditioner shown in FIG. 11.
Figure 11:
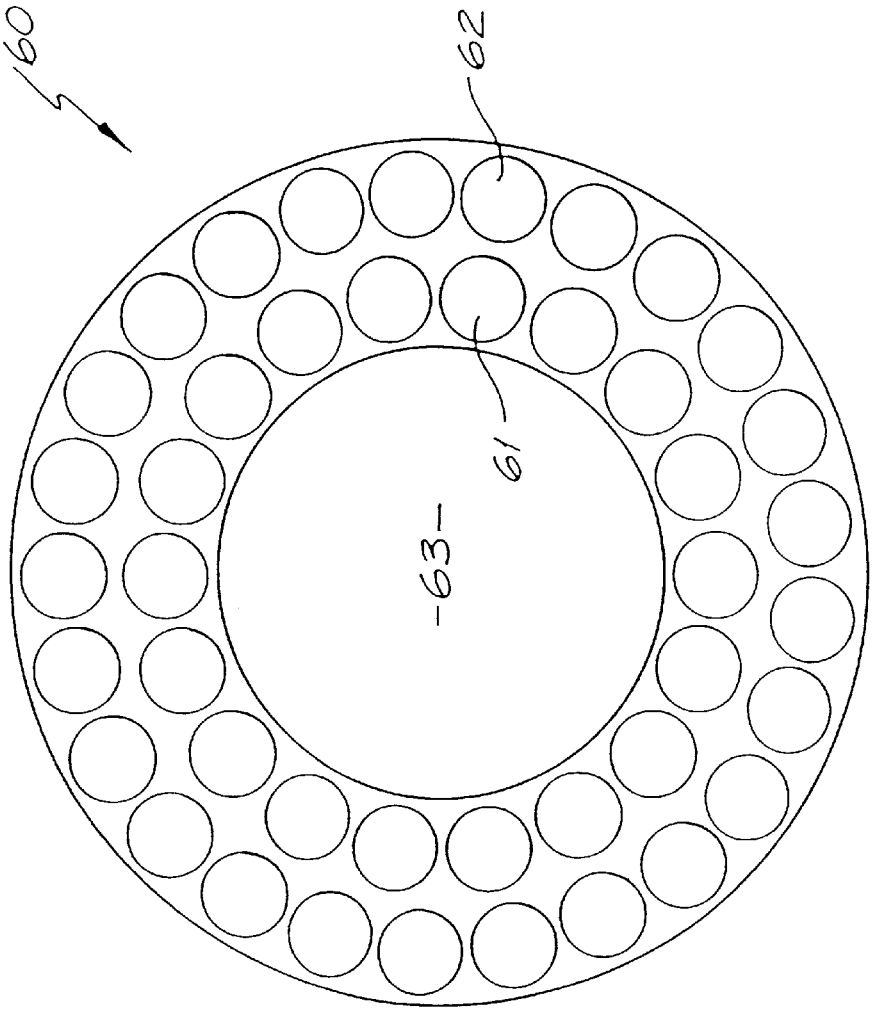
FIG. 11 is a front elevational view of a plate-type flow conditioner according to a fourth embodiment of the invention.

A flow conditioner 60 suitable for use with a nozzle having co-axial proportioners is shown in FIGS. 11 and 12. The flow conditioner 60 has a central bare 63 and two concentric arrays 61 and 62 of passageways. The inner array 61 has 18 passageways and the outer array 62 has 24 or 25 passageways. In this instance, the plate 60 is 18 mm thick and has a diameter of 152 mm and each passageway has a diameter of 16 mm and each upstream end and downstream end is 2 mm long.

Figure 13:
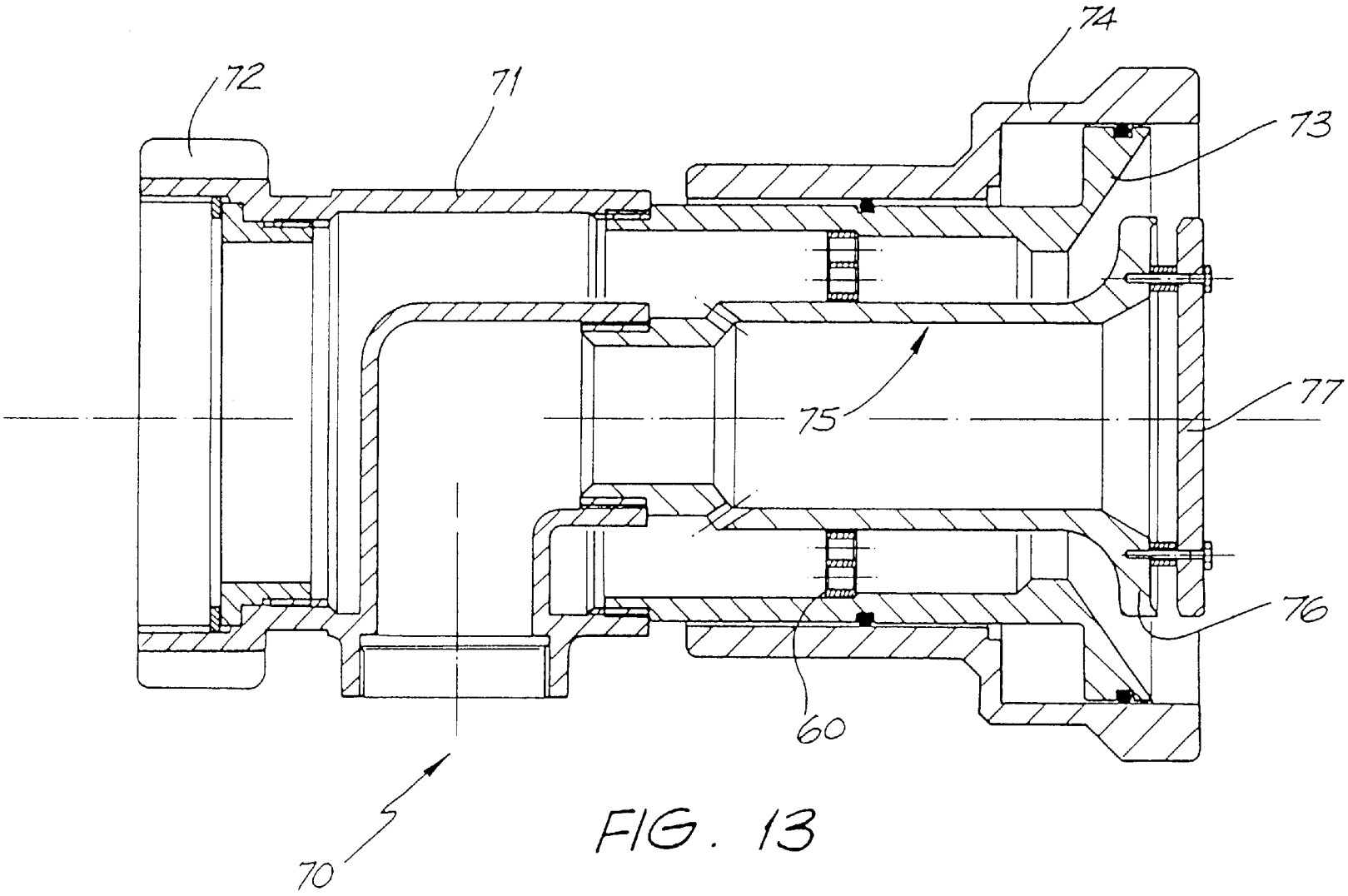
FIG. 13 is a cross-sectional view of a nozzle having co-axial proportioners incorporating a flow conditioner of the kind shown in FIGS. 11 and 12.

The co-axlal type nozzle 70 shown in FIG. 13 incorporates a flow conditioner 60 of FIGS. 11 and 12 The nozzle 70 Includes a proportioner element 71. a coupling 72, a nozzle body 73, and a shaper 74. Within the shaper 74 there is a stem 75 having a steamhead 76 and stemplate 77. The conditioner 60 is located within nozzle body 73.

Various modifications may be made in details of design and construction of the flow conditioner without departing from the scope and ambit of the invention.

I claim:

1. A fluid flow apparatus comprising:

a nozzle having a hollow body portion;

coupling means for connecting the nozzle to a supply of fluid;

a nozzle piece through which fluid flows out of the nozzle; and a fluid flow conditioner located in said body portion between said coupling means and said nozzle piece, said fluid flow conditioner comprising: a plate having a plurality of fluid passageways therethrough, each said fluid passageway having an upstream end that is tapered inwardly in the direction of fluid flow and a downstream end that is tapered outwardly in the direction of fluid flow.

2. A fluid flow apparatus according to claim 1 wherein each fluid passageway has a portion of constant cross-section between the upstream end and the downstream end.

3. A fluid flow apparatus according to claim 2 wherein the constant cross-section portion is substantially longer than the tapered upstream end or the tapered downstream end.

4. A fluid flow apparatus according to claim 2 wherein the tapered downstream end is substantially longer than the tapered upstream end or the portion of constant cross-section.

5. A fluid flow apparatus according to claim 4 wherein the tapered downstream end is a diffuser.

6. A fluid flow apparatus according to claim 5 wherein the diffuser is of conical shape.

7. A fluid flow apparatus according to claim 6 wherein the included angle of the conical shaped diffuser is in the range of 0 to 15 degrees.

8. A fluid flow apparatus according to claim 6 wherein the included angle of the conical shaped diffuser is in the range of 6 to 10 degrees.

9. A fluid flow apparatus according to claim 6 wherein the diffuser is trumpet shaped.

10. A fluid flow apparatus according to claim 1, wherein said fluid flow conditioner includes a central fluid passageway, a first array of six fluid passageways and a second array of twelve fluid passageways, said first and second arrays being located on circles which are concentric with a center of said central fluid passageway, said second array being located radially outwardly from said first array.

11. A fluid flow apparatus according to claim 10 which further includes a third array of passageways located on a circle which is concentric with the center of said central passageway and which is located radially outwardly from said second array.

12. A fluid flow apparatus according to claim 11 which further includes a fourth array of passageways located on a circle which is concentric with the center of said central passageway and which is located radially outwardly from said third array.

13. A fluid flow apparatus according to claim 1, wherein said fluid flow conditioner includes a central bore and inner and outer concentric arrays of passageways.

14. A fluid flow apparatus according to claim 1, wherein the diameter of each of said fluid passageways are between 0.1 to 0.18 times the diameter of said plate.

15. A fluid flow apparatus according to claim 1, wherein the diameter of each of said fluid passageways are between 0.8 to 0.13 times the diameter of said plate.

16. A fluid flow apparatus according to claim 1, wherein the diameter of each of said fluid passageways are between 0.05 to 0.1 times the diameter of said plate.

17. A fluid flow apparatus according to claim 1, wherein the thickness of said plate is between 0.6 to 1.7 times the diameter of each of said passageways.

18. A fluid flow apparatus according to claim 2 wherein the upstream end and downstream end of each passageway is 0.1 times the diameter of the passageway.

19. A fluid flow apparatus according to claim 5 wherein the diffuser is 0.3 times the thickness of the plate.

20. A fluid flow apparatus according to claim 19 wherein the portion of constant cross-section is from 0.2 to 0.5 times the diameter of the passageway.

21. A fluid flow apparatus according to claim 13 which further includes a stem portion which extends axially within said body portion, said stem portion being positioned within said central bore of said fluid flow conditioner.

22. A fluid flow apparatus comprising:

a nozzle having a hollow body portion;

coupling means for connecting the nozzle to a supply of fluid;

a nozzle piece through which fluid flows out of the nozzle; and a fluid flow conditioner located in said body portion between said coupling means and said nozzle piece, said fluid flow conditioner comprising: a plate having a plurality of fluid passageways therethrough, each said fluid passageway having an upstream end that is tapered inwardly in the direction of fluid flow and a downstream end that is tapered outwardly in the direction of fluid flow and having a portion of constant cross-section between the upstream and downstream end, said tapered downstream end comprising a conical-shaped diffuser and being substantially longer than the tapered upstream end or the portion of constant cross-section, said conical shaped diffuser having an included angle in the range of 6 to 10 degrees.

23. A fluid flow apparatus comprising:

a nozzle having a hollow body portion;

coupling means for connecting the nozzle to a supply of fluid;

a nozzle piece through which fluid flows out of the nozzle; and a fluid flow conditioner located in said body portion between said coupling means and said nozzle piece, said fluid flow conditioner comprising: a plate having a plurality of fluid passageways therethrough, each said fluid passageway having an upstream end that is tapered inwardly in the direction of fluid flow and a downstream end that is tapered outwardly in the direction of fluid flow and having a portion of constant cross-section between the upstream and downstream end, said tapered downstream end comprising a diffuser having a trumpet shape and being substantially longer than the tapered upstream end or the portion of constant cross-section.

* * * * *